United States Patent [19]

Heiskell

[11] 4,385,544

[45] May 31, 1983

[54] DRUMSTICK AND METHOD OF MANUFACTURE

[76] Inventor: Ronald E. Heiskell, 2632 Mallard Ct., Union City, Calif. 94587

[21] Appl. No.: 231,860

[22] Filed: Feb. 5, 1981

[51] Int. Cl.[3] ..... G10D 13/02
[52] U.S. Cl. ..... 84/422 S
[58] Field of Search ..... 84/422 S

[56] References Cited

U.S. PATENT DOCUMENTS

| | | | |
|---|---|---|---|
| 3,146,659 | 9/1964 | Robba et al. | 84/422 S |
| 3,489,052 | 1/1970 | Colyer et al. | 84/422 S |
| 4,246,826 | 1/1981 | Warrick et al. | 84/422 S |
| 4,300,438 | 11/1981 | Handal | 84/422 S |

*Primary Examiner*—Lawrence R. Franklin
*Attorney, Agent, or Firm*—Keith T. Bleuer

[57] ABSTRACT

A drumstick is made of initially flat fabric rolled upon itself repeatedly about a central axis. Material impregnating all of the resulting several layers of fabric and solidified holds the fabric tube together.

8 Claims, 8 Drawing Figures

DRUMSTICK AND METHOD OF MANUFACTURE

This invention relates to drumsticks used for striking percussion instruments such as a conventional set of drums, snare drums, tom-toms, bongos, cymbals, cowbells, timbales, wood blocks, parade drums, electronic drums and the like.

The conventional solid wooden drumsticks have long been the standard and the most accepted drumsticks in the percussion field. The tonal response, the center of gravity, the weight, the balance, the axial stiffness and the overall "feel" of wooden drumsticks has been recognized as the optimum by most percussionists.

There are, however, inherent disadvantages of wooden drumsticks. They have a very short useful life due to chipping, splintering and cracking. After wooden drumsticks are manufactured they continue to change in moisture content and this causes the drumstick to lose its linear straightness, commonly known as warping. Warped drumsticks then have increased internal stresses which cause the drumstick to crack when struck with a transverse impact blow such as those induced by rim shots wherein the metal rim of the drum is struck by the shaft of the drumstick at the same time the tip hits the drum head and also those induced by cymbal crashes. The innate characteristics of wood itself cause wooden drumsticks to chip, splinter, and crack, whether warped or not, when subjected to these high impact blows. Another disadvantage of wooden drumsticks is that the drumstick at times will tend to rotate out of the percussionist's hand when struck sharply due to variation in grain and moisture content resulting in varying weight distributions within the particular drumstick. Ideally both drumsticks in a pair should be matched in tone, weight, center of gravity, balance and straightness but due to the inconsistencies of wood it can be a difficult task to find such a pair. Another disadvantage of wooden drumsticks is that they become slippery when the percussionist's hands perspire, causing the drummer to lose his grip and drop the drumstick.

There have been attempts at improving the characteristics of wooden drumsticks by chemically treating the wood, but these attempts have failed in producing a more durable drumstick. In the prior art drumsticks have been introduced which are made of metals, plastics, fibers bound together with resins, unwoven glass fiber mats bound by resins and combinations of the above but each of these has failed in producing a drumstick which is equivalent in tonal quality to wood and more durable than wood. In particular the drumstick made of a hollow aluminum shaft for the handle and molded plastic for the tapered shoulder did prove to be more durable than wood but the resonance effect produced by the aluminum in executing rim shots and cymbal crashes did not match the tonal response of wood and thus has not been readily accepted by percussionists. This is also true of the drumstick made entirely of aluminum tubing. Another disadvantage of aluminum drumsticks and the combinations thereof, is that the percentage of length between the butt end and the center of gravity ranged from 49% to 58% of the drumstick length, whereas wooden drumsticks maintain a percentage of 42% to 48%. This shift in the center of gravity towards the tip of drumsticks made of aluminum has proven to be an undesirable weight distribution. Yet another disadvantage of drumsticks made with metal is that vibration is more readily transmitted to the percussionist's hands during use which causes the "feel" to be very unlike that of wooden drumsticks.

In the case of a drumstick made of molded fiber and resin, the impact strength was not significantly improved upon over wooden drumsticks and the resultant part proved to be slippery in the percussionist's hands. In an attempt to duplicate the weight distribution, flexural characteristics and absolute weight of wooden drumsticks, unwoven glass fibers and resin were used to produce a hollow drumstick but the result was a drumstick with very poor impact resistance. Such drumsticks have also incorporated a hollow aluminum reinforcing tube bonded to the inside diameter to increase its impact strength. With repeated blows, however, the unwoven glass fiber would break down, exposing the aluminum tube thereby resulting in the same poor tonal quality of aluminum drumsticks when executing rim shots and cymbal crashes. Thus there is a great need for a drumstick having the desirable characteristics of wooden drumsticks with the added advantage of increased durability, stick to stick uniformity in sound, weight and balance, a non-slip surface, and moisture and warp resistance.

More particularly this invention relates to a hollow drumstick having the desired characteristics of wooden drumsticks without the inherent disadvantages. The drumstick of the invention is designed to provide a greater durability and a "feel" that far exceeds the performance of any drumsticks of the prior art. This invention also relates to a method of manufacturing of said drumstick having the construction of a resin impregnated woven fiberglass fabric.

One of the objects of this invention, therefore, is to provide a new and improved drumstick which retains all of the desirable characteristics of wooden drumsticks, such as the location of the center of gravity, the tonal quality, the axial stiffness, the weight in relation to the outside diameter and length and the overall "feel".

Another object of this invention is to provide a new and improved drumstick which has greater durability in withstanding transverse impact blows and yet a capability to absorb enough of the impact so as to not transmit an undesirable amount of shock vibration to the percussionist's hands.

Yet another object of this invention is to provide a new and improved drumstick in which the sound, weight and center of gravity can be maintained with good reproducibility in manufacturing thereby producing matched drumsticks.

An additional object of this invention is to provide a new and improved drumstick which has a non-slip surface on the main body or shaft.

A further object of this invention is to provide a new and improved drumstick which is moisture and warp resistant thereby providing a drumstick which will always be straight.

Another object of this invention is to provide a new method of manufacturing the drumstick which is both simple and economical.

My invention includes a drumstick made by first shaping a woven fabric which is impregnated with a thermosetting resin in a cylindrical roll, then curing the resin under heat to form a multi-layer, hollow, cylindrical tube and a similarly formed second, hollow, multi-layer cylindrical tube which is small enough to telescope into the first tube. The exterior of the two tubes is tapered toward one end, and an impact ball is secured at the end of the second tube.

These and other objects and advantages of this invention will become apparent upon consideration of the following description relating to a particular embodiment or embodiments, and of the drawings, in which like reference numerals designate like parts throughout the same.

Figure 1:
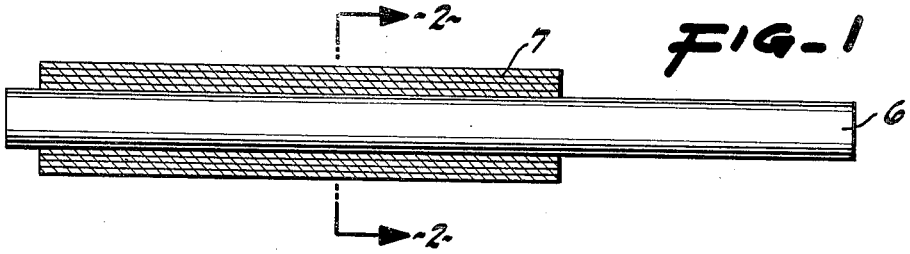
FIG. 1 is a cross-section on a longitudinal plane, with portions being broken away, of a first drumstick portion constructed pursuant to the invention.
Figure 2:
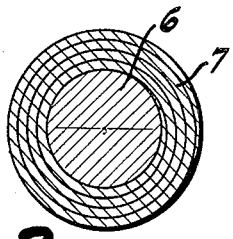
FIG. 2 is a cross-section, the plane of which is indicated by the lines 2—2 of FIG. 1 but the scale being enlarged.

In the drumstick of the invention the fabric employed is resin impregnated woven fabric. Woven fabric was chosen over unwoven because there is more consistent uniformity in weight and orientation when there is a weave thereby resulting in greater reproducibility on the drumsticks. It has also been shown by impact tests on various weaves and sizes of yarn that tying the longitudinal yarns together with cross weaves increases the impact strength. The results of Izod impact strength tests, according to ASTM D-256 performed on flat laminates all impregnated with the same epoxy resin system are as follows:

TABLE 1

IZOD IMPACT STRENGTH TESTS IN ACCORDANCE WITH ASTM D-256

| Fabric Sample | Count Warp × Fill | Yarn Size (Yds./Lb.) Warp × Fill | Pattern | Average Thickness (Inches) | Avg. Width of Sample (Inches) | Avg. Breaking Load (In.-Lb.) | Avg. Izod Impact Strength (Ft.-Lbs./ In. of Notch) |
|---|---|---|---|---|---|---|---|
| 1 | 120 × 24 | 7500 × 15000 | 8 harness satin weave | .015 | .130 | 78.12 | 50.1 |
| 2 | 57 × 54 | 7500 × 15000 | 8 harness satin weave | .011 | .135 | 33.1 | 20.4 |
| 3 | 60 × 58 | 45000 × 45000 | plain | .004 | .114 | 15.74 | 11.5 |

In discussing woven fabric several criteria must be considered, namely the count, yarn size, and pattern. The count describes the number of yarns in the warp (length) and the number of yarns in the fill (width). As seen in TABLE 1 all characteristics of fabric samples 1 and 2 were similar to each other except the count, whereas sample 1 is unidirectional and sample 2 is bidirectional. The resultant Izod impact strength reveals that greatest impact strength is obtained by having more longitudinal yarns (warp) tied together with a lesser number of yarns in the cross weave (fill). Greater impact strength is also achieved when the crimping of the warp yarns is held to a minimum. This was achieved by using a yarn in the fill which is ½ the size of the warp (see Table 1 Yarn Size), and by using a weave which passes the fill yarn under one and over seven yarns in the warp, namely an 8 harness satin weave. Fabric sample 3 from TABLE 1 also verifies this in that a bi-directional count was used with a very small yarn size but same size in both directions, in an under-over, under-over pattern, namely a plain weave. The plain weave produced a crimping effect in the warp which reduced the Izod impact strength by 77%. For these reasons fabric sample 1 was preferred.

In the particular embodiment shown in the drawing there is initially provided a first mandrel 6 which is coated with a suitable release agent to permit subsequent removal from the cured drumstick shaft. The mandrel is a substantially circular, cylindrical, elongated body of steel or any appropriate permanent material having appropriate proportions and dimensions for a typical drumstick. In this case cold roll steel was chosen with an outside diameter of 0.375 inches.

Starting onto and wound onto the mandrel 6 is a strip 7 of the fabric sample 1 of TABLE 1, of a prescribed dimension to produce the desired diameter, being oriented so that the warp is longitudinal to the drumstick. The fabric having been impregnated with a resin, namely an epoxy aliphatic, amine cured resin system with a resin content in the range of 20 to 40%, is then placed on the mandrel 6 and attached by running a hot iron along the edge. This melts the resin impregnated into the fabric thus bonding it to the mandrel 6. The mandrel is then rolled between two flat planes, namely a rolling table, which rolls the resin impregnated woven fabric upon itself a number of times. FIG. 1 shows the forming of the larger diameter tube. Typically the diameter of this resultant tube ranges from 0.560 to 0.575 inches with a wall thickness range of 0.093 to 0.100 inches.

After the multiple layers are wrapped around the mandrel to achieve the desired diameter, the entire unit is wrapped with heat-shrinkable thin film pressure tape in a spiral fashion along the entire length of the unit. As a typical case first ½ inch wide polypropylene is wrapped and the followed by ½ inch wide cellophane to give the desired pressure. The purpose of this process is to add pressure to the unit so that it will remain tightly wrapped during curing which will produce a very tight homogeneous, high density tube which is free of voids.

Figure 3:
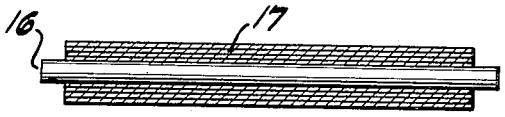
FIG. 3 is a view comparable to FIG. 1 but showing a second smaller diameter portion of the drumstick.

The second element shown in FIG. 3 is formed by strip 17 of the fabric being wound onto mandrel 16, having a diameter in this case of 0.093 inches, by the above process except in this case the number of layers of resin impregnated fabric is controlled to be slightly larger than the inside diameter of the tube of FIG. 1 after the two are heat cured. The length of this second tube is chosen so as to give adequate strength and proper center of gravity to the resulting drumstick. In this embodiment this length is 3.375 inches.

Both units in FIGS. 1 and 3 are then heat cured. The time and temperature of the curing is obviously dependent upon the resin system chosen. In this case of an epoxy resin system the following cure cycle was used: 290° F. for 30 minutes.

The fabric used in making both the first element as shown in FIG. 1 and the second element as shown in FIG. 3 is preferably initially flat fiberglass fabric having an eight harness satin weave with a warp count of 120 and fill count of 24 and with a warp yarn size of 7,500 yards per pound and a fill yarn size of 15,000 yards per pound, with the fabric being impregnated with an epoxy aliphatic, amine cured resin system in the amount of 20% to 40% of the total fabric resin weight and curing the helical roll of impregnated fiberglass by heating to 290° F. for approximately 20 minutes, to 325° F. for approximately 40 minutes and to 350° F. for approximately 30 minutes.

Figure 4:
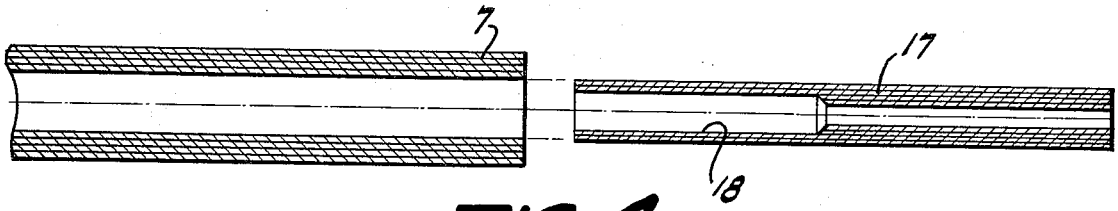
FIG. 4 is a view comparable to FIGS. 1 and 3, indicating the assembly operation of combining the second tube and the first tube.
Figure 5:
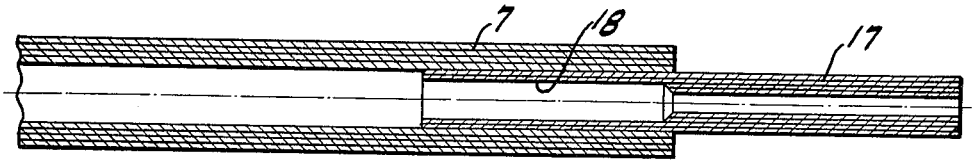
FIG. 5 is a view comparable to FIG. 4 but showing the parts substantially in a united relationship.

After curing both parts are stripped of their heat-shrinkable tape and the mandrels 6 and 16 are removed from the two parts. Then the inside diameter of the larger diameter tube is drilled or reamed out so as to remove any remaining release agent and the smaller diameter tube is turned down or surface ground so as to effect a tight fit into the larger diameter tube. The smaller diameter tube is also drilled at 18, FIG. 4, to effect the center of gravity of the main body of the drumstick and to maintain a desired wall thickness for impact strength. In this case it was drilled to 0.218 inches inside diameter, extending 1.50 inches in length. The drilled end of the smaller diameter tube, which has a roughened surface due to turning or grinding to assure a good bond, is provided with an appropriate outer coating of suitable adhesive such as epoxy adhesive. The two members are then telescoped axially far enough so that they occupy a position substantially as shown in FIG. 5. This position is chosen so as to give adequate strength and proper center of gravity to the main body of the drumstick. In this embodiment it is telescoped 1.50 inches into the larger diameter tube. When this has been done and the uniting epoxy adhesive has substantially solidified or hardened then the main body of the drumstick has been completed.

The helical imprints on the drumstick from the pressure of the heat-shrinkable tape can be left on the surface rather than ground or sanded off. This produces a non-slip surface for the percussionist and maintains an approximate 30% greater surface strength as compared to sanding the surface.

Figure 6:
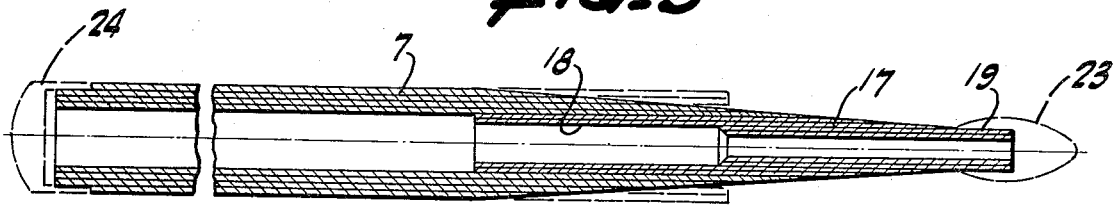
FIG. 6 is a view comparable to FIG. 5 but showing the exterior of the assembled structures having a generally conical configuration at one end, and an annular reduced portion at the other end.
Figure 7:
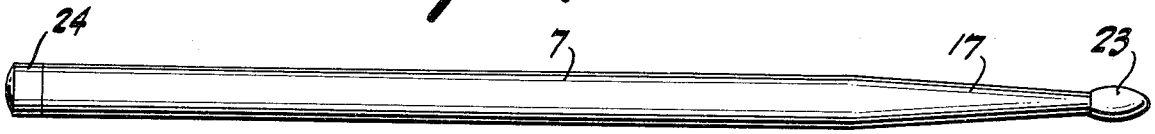
FIG. 7 is a side elevation to a reduced scale showing the full extent and proportion of a drumstick pursuant to the invention.

The outer surface of the assembly, starting at a point 3.375 inches from the end of the smaller tube, is then tapered in a lathe or centerless grinder as shown in FIG. 6 to constitute substantially a continuous, smooth cone, stopping at a point before the end of the smaller tube, typically 0.450 inches, so as to make a straight portion 19 at the area close to the end, in this case 0.200 inches in diameter. On this straight portion there is added onto the exterior a drumstick ball or tip 23 of the usual sort with a smaller inside diameter than the outside diameter of straight portion 19. This likewise is secured in position by a press fit, and bonded with an appropriate adhesive such as epoxy. Comparably, as shown in FIGS. 6 and 7, the other end of the large tube can be provided with a butt cap 24 of an appropriate nature fixed in the same way, by turning down the large tube to make an annular reduced portion to facilitate a press fit with the butt cap and then bonded thereto. The tip 23 and butt cap 24, are constructed of a high strength plastic which was chosen for its high machinability and high impact strength such as nylon or an acetal resin commercially available as "Delrin" (trademark of E. I. du Pont de Nemours & Co., Inc.).

The completed drumstick, in this case has an overall length of approximately 16 inches, an outside diameter of the shaft portion of 0.560 to 0.575 inches, a weight ranging from 55 to 65 grams, and a center of gravity of 7 to 7½ inches from the butt cap. These values all fall within the accepted characteristics of wooden drumsticks.

The resultant drumstick of the foregoing description meets all of the objectives and intents set forth and makes available a new and improved drumstick which is moisture and warp resistant, having the desired outside diameter, overall length, center of gravity, balance, tonal quality and axial stiffness. In addition a non-slip surface is provided by the method of manufacturing. A considerable range of colors for the drumstick is also available by pigmenting the resin. The resultant drumstick retains all of the desirable characteristics of wooden drumsticks while increasing the impact strength as the following table shows:

TABLE 2

TESTS PERFORMED ON A RIEHLE IMPACT TESTING MACHINE

| Sample | Average Diameter at Impact Point (Inches) | Average Breaking Load (Foot-Lbs.) |
|---|---|---|
| Wooden Drumstick | .587 | 13.0 |
| Drumstick in Accordance with the Invention | .562 | 31.6 |
| Wooden Drumstick - Impacted 2¼ Inch from the Tip | .463 | 36.75 |
| Drumstick in Accordance with the Invention - Impacted 2¼ Inch from the Tip | .424 | 66.25 |

The weight of the drumsticks is very constant and repeatable and the properties of the drumsticks can be varied by changing the type of resin, the percentage of resin, the fabric, the curing process, and the inside and outside dimensions. These properties too can be closely controlled which cannot, of course, be done with solid wood drumsticks. All such variations are particularly important when it is recognized that the drumsticks form a part of the pitch development of the drum or percussion instrument.

Figure 8:
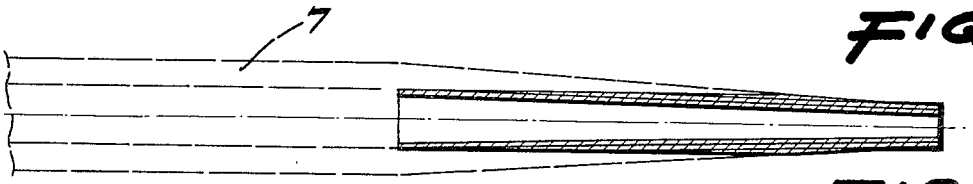
FIG. 8 is a view comparable to FIG. 5, but showing a modified form of end insertion or second tube for the drumstick.

As a possible variation, as shown in FIG. 8, one may alter the mandrel 16 as shown in FIG. 3 and utilize a tapered form, wrapping the surrounding resin impregnated fabric around the tapered form in a number of layers to make a conical interior void as shown in FIG. 8. The remaining part of the drumstick in FIG. 8 is substantially as otherwise disclosed.

Another possible variation is that pressure and temperature can be applied to the units, as shown in FIGS. 1 and 3, in an autoclave, thereby eliminating the need for heat shrinkable tape and an oven. This would produce a smooth drumstick with excellent surface strength, but would not give an inherent non-slip surface.

Moreover, it should be recognized that while the invention has been described in connection with the drumstick formed of two portions, it will, of course, be possible to make a heavier drumstick by making the entire drumstick upon the mandrel 16 and wrapping it to a sufficient thickness to reach the dimensions shown for the larger portion thereby making a far more dense and heavy drumstick. This drumstick could then be drilled out to approximate the inside diameter of the described drumstick. This method is not preferred, however, due to large material waste and subsequent cost limitations.

Moreover, it will be possible, of course, to manufacture the drumstick in accordance with the invention from more than two parts as shown so as to further alter the shape and center of gravity of the drumstick.

Whereas this invention has been described by preferred embodiments which gives desirable results it should be considered in all respects as illustrative and not restrictive. It is understood that this invention may be embodied in specific forms other than those which have been described above without departing from the scope or essential attributes of the invention as defined by the claims.

What is claimed is:

1. A drumstick comprising:

a handle portion consisting of a cylindrical tube of resin impregnated woven fabric, said tube having an internal cylindrical cavity of known diameter;

a shank portion consisting of a second cylindrical tube of said resin impregnated woven fabric, the external diameter of said second tube being approximately the same as said first tube internal cavity, said second tube having an internal cylindrical cavity of known diameter, a portion of which is drilled to a larger diameter than said second known diameter, the diameter and length of said drilled portion being selected to control the center of gravity of said drumstick;

said shank portion and said handle portion being telescopically joined a preselected depth to further control said center of gravity and adhesively fixed together;

said handle portion and said shank portion being machined to form a continuous, smooth cone from the telescopically joined portion to a point before the end of said shank portion and to form a short cylindrical portion to said end; and a tip adhesively secured to said short cylindrical portion.

2. The drumstick of claim 1 wherein said external diameter of said second tube is slightly larger than said first tube internal diameter, said first tube internal diameter being enlarged in said telescopically joined portion, or said second tube external diameter being reduced, or both, to effect a close fit of said two tubes when telescoped together.

3. The drumstick of claim 1 wherein said handle portion and said shank portion are heat cured by a thermosetting process.

4. The drumstick of claim 3 wherein a non-slip surface is produced on said handle portion by a spiral wrap plastic film applied prior to said thermosetting.

5. The drumstick of claim 1 wherein said woven fabric has a warp count higher than the fill count and the weave is an 8 harness satin weave.

6. The drumstick of claim 1 further including a butt cap fixed to the end of said handle portion remote from said shank.

7. The drumstick of claim 6 wherein said tip and said butt cap are made of Delrin.

8. A drumstick comprising:

a handle portion consisting of a cylindrical tube of resin impregnated woven fabric, said tube having an internal cylindrical cavity of known diameter;

a shank portion consisting of a second cylindrical tube of said resin impregnated woven fabric, the external diameter of said second tube being approximately the same as said first tube internal cavity, said second tube having an internal cylindrical cavity of known diameter, a portion of which is drilled to a larger diameter than said second known diameter, the diameter and length of said drilled portion being selected to control the center of gravity of said drumstick;

said shank portion and said handle portion being telescopically joined a preselected depth to further control said center of gravity and adhesively fixed together;

said handle portion and said shank portion being machined to form a continuous, smooth cone from the telescopically joined portion to the end of the cone; and a tip on the end of said cone and being larger in diameter than said cone at its said end.

* * * * *